US007040099B2

(12) United States Patent
Huber et al.

(10) Patent No.: US 7,040,099 B2
(45) Date of Patent: May 9, 2006

(54) CRYOSTAT

(75) Inventors: Norbert Huber, Erlangen (DE); Rudolf Röckelein, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 106 days.

(21) Appl. No.: 10/300,940

(22) Filed: Nov. 21, 2002

(65) Prior Publication Data

US 2004/0035121 A1 Feb. 26, 2004

(30) Foreign Application Priority Data

Nov. 21, 2001 (DE) ..... 101 57 105

(51) Int. Cl.
*F17C 7/02* (2006.01)

(52) U.S. Cl. ..... 62/51.1; 62/45.1

(58) Field of Classification Search ..... 62/45.1, 62/51.1, 50.7; 220/560.13, 592.21; 141/331
See application file for complete search history.

(56) References Cited

U.S. PATENT DOCUMENTS 3,258,602 A * 6/1966 Promish ..... 250/238
3,368,076 A * 2/1968 Clifford ..... 250/352
3,413,468 A * 11/1968 Astheimer ..... 250/338.1
3,714,796 A * 2/1973 Longsworth ..... 62/514
4,291,541 A 9/1981 Kneip, Jr. et al.
4,990,878 A 2/1991 Takechi et al.
5,086,619 A * 2/1992 Huang et al. ..... 62/50.1
5,265,430 A * 11/1993 Chen et al. ..... 62/48.1

FOREIGN PATENT DOCUMENTS

| | | |
|---|---|---|
| DE | 39 42 579 | 2/1990 |
| DE | 39 24579 A1 | 2/1990 |
| DE | 43 14 806 | 6/1995 |
| EP | 250 675 B1 | 1/1988 |
| EP | 414 528 B1 | 2/1991 |
| EP | 587 423 B1 | 3/1994 |
| EP | 642 641 B1 | 3/1995 |
| EP | 736 778 B1 | 10/1996 |
| EP | 0 623 779 | 3/1997 |
| EP | 0 736 778 | 7/1999 |

OTHER PUBLICATIONS

English Abstract for Japanese Patent Application 7192898 A, Jul. 28, 1995.

* cited by examiner

*Primary Examiner*—William C Doerrler
(74) *Attorney, Agent, or Firm*—Staas & Halsey LLP

(57) ABSTRACT

A cryostat having a connecting branch which is connected to a coolant chamber and is open on the end side. The connecting branch expands from an inside diameter to an outside diameter.

11 Claims, 3 Drawing Sheets

CRYOSTAT

CROSS REFERENCE TO RELATED APPLICATIONS

This application is based on and hereby claims priority to German Application No. 101 57 105.4 filed on Nov. 21, 2001, the contents of which are hereby incorporated by reference.

BACKGROUND OF THE INVENTION

The invention relates to a cryostat having a connecting branch which is connected to a cooling chamber and is open on the end side, for example according to DE 39 24 579 A1.

Cryostats of this type are known and are used wherever an object has to be cooled to a very low temperature. Liquid nitrogen having a temperature of 77 K or liquid helium having a temperature of 4.3 K are usually used as coolant, which is provided in a coolant chamber of the cryostat. A cryostat is used, for example, in a magnetic resonance investigation device primarily used for medical purposes (cf., for example, DE 39 24 579 A1, EP 0 587 423 B1 or EP 0 736 778 B1), or else in investigation devices for analytical purposes in the chemistry field (cf., for example, U.S. Pat. No. 4,291,541 A). When a cryostat is used in a magnetic resonance tomograph, the cryostat is used for cooling the superconductive magnet used for generating the basic field. The cryostat in question has an open connecting branch, i.e. it is an open system in which the coolant chamber containing the liquid coolant is connected to the environment. The liquid coolant does not rapidly volatilize via the open connecting branch because a boiling equilibrium is set, and the supply of heat and energy to the coolant via the connecting branch is relatively small, so that very little coolant evaporates. Customary maintenance cycles within which coolant has to be topped up are approximately a year in the case of known magnetic resonance tomographs.

In the case of such a cryostat of a magnetic resonance tomograph, the connecting branch has a number of properties. Firstly, the first filling of the coolant chamber with coolant and topping up of the coolant can take place via the cryostat. Secondly, evaporating coolant can volatilize via the cryostat, the coolant having to volatilize in the case of an open system in order to avoid the internal pressure in the coolant chamber rising to an impermissibly high level. Moreover, the connecting branch is also used, if appropriate, for accommodating an electrode which is connected to the superconductive magnet when starting up the system. Via this electrode and a second electrode, which is likewise connected to the superconductive magnet, a current is guided over the superconductive magnet and, after reaching the transition temperature and with the magnet sufficiently cooled, is guided in a loss-free manner in the magnet, after which the two electrodes are separated from the superconductive magnet.

In this case, essentially three requirements have to be fulfilled by the connecting branch. Firstly, when accommodating an electrode it is to heat up as little as possible in order to avoid an impermissibly high transport of heat taking place in the direction of the coolant chamber via the connecting branch or via the shields insulating the coolant chamber to the outside. Furthermore, small transport of heat from the environment into the interior of the cryostat during operation is to take place via the connecting branch. Finally, a pressure loss which is as small as possible has to be provided when volatilizing coolant flows through the connecting branch, for example in the event of a quench. In the case of a quench, the superconductive magnet becomes impermissibly hot at one point and transfers into the standard conductive state, which is associated with local heating which spreads and results, in the worst case, in the entire superconductive magnet transferring into the standard conductive state. Above all, the transport of heat into the interior of the cryostat via the connecting branch has a great effect on the duration of the maintenance cycle. The lower the heat input, the longer can the maintenance cycles be, which has a significant effect on the competitiveness of the product.

In order to reduce the incorporation of heat by heat radiation, it is known to fit anti-radiation shields in the interior of the essentially cylindrical connecting branch, the shields being arranged in such a manner that the connecting branch is optically closed, as seen from the outside. That is to say, heat radiation can only be guided to the inside to a limited extent and is for the most part reflected by the anti-radiation shields. However, these anti-radiation shields result in a poorer quenching behavior, since, although the flow channel is open as before, they nevertheless form a sufficient flow resistance, which results in a relatively high pressure loss as the volatilized refrigerant flows through in the event of a quench.

SUMMARY OF THE INVENTION

The invention is therefore based on the problem of specifying a cryostat with reduced heat input via the connecting branch.

To solve this problem, the invention makes provision, in the case of a cryostat of the type mentioned at the beginning, for the connecting branch to expand from an inside diameter $D_i$ to an outside diameter $D_a$.

In comparison with previously used, cylindrical connecting branches, the invention proposes a diverging connection branch which expands outward in a nozzle-like manner. This diverging wall profile results in heat radiation which enters into the connecting branch being reflected in a different manner than would be the case in a cylindrical connecting branch. By this means, the angle of the radiation which can be incorporated, which can be incorporated into the interior of the cryostat by reflection, can be significantly reduced. Overall, diffuse heat radiation and also reflected and re-emitted heat radiation can be significantly reduced in this way.

According to a first refinement of the invention, the diameter can expand linearly, i.e. the connecting branch is of frustoconical design. As an alternative to this, there is also the possibility of using a connecting branch which expands convexly or concavely.

In order to modify the cross section of the connecting branch, there can be provided therein, according to a development of the inventive concept, an elongate, preferably axially extending component which, in particular, is arranged concentrically with the connecting branch, its diameter tapering—in a reverse manner to the profile of the connecting branch diameter—from an inside diameter $d_i$ to an outside diameter $d_a$. That is to say, the diameter decreases from the inside to the outside. This likewise leads to a somewhat changed reflection behavior, so that by this measure the overall input of heat radiation can be further reduced. The diameter can also taper linearly, convexly or concavely in this component.

An expedient development of the inventive concept makes provision for one or both of the inner wall of the connecting branch and the outer wall of the component to be at least partially coated or surface-treated in order to influence the absorption or emission behavior. The heat radiation impacts against the inner or the outer wall of the respective element. The heat radiation is influenced differently depending on the absorption or emission behavior of the wall section against which the heat radiation impacts. That is to say, this refinement of the invention permits a specific setting of the absorption or emission parameters of the respective wall or particular wall sections. For example, a strongly absorbent coating can be applied as the coating, for example a non-metallic coating of a metal oxide, for example $ZrO_2$ or a ceramic material or the like. A coating of this type is expediently provided in the region of the connecting branch or in the region of the component, at the upper, open outlet end, since a slight, radiation-induced heating at this point does not have too great an effect on the overall heat balance used to define the heat input. In the context of the surface treatment a black coloration by corresponding, chemical treatment of the connecting branch or the formation of a reflective surface, for example by polishing or applying a reflective layer or the like may also be provided, for example. The transport of heat by heat radiation may also be reduced in this way.

Furthermore, it is expedient if the connecting branch is connected to a housing section of the cryostat via a curved connecting region. This is advantageous with regard to minimizing the pressure loss via the connecting branch. If the avoiding of the anti-radiation shields has already led to an improvement with regard to the pressure conditions, then the connection according to the invention of the connecting branch via the curved connecting region affords a further improvement, since this results in an improved flow profile of the coolant gas at the inlet into the connecting branch. Volatilizing coolant which, for its part, leads to re-cooling of the heating-up connecting branch or the component ("exhaust gas cooling") can now flow into and through the connecting branch in an even less obstructed manner and better in terms of flow, with the result that the cooling result is also improved.

In addition to the cryostat, the invention also relates to a magnetic resonance device including a cryostat of the type described.

Further advantages, features and details of the invention emerge from the exemplary embodiments which are described below and with reference to the drawings, in which:

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
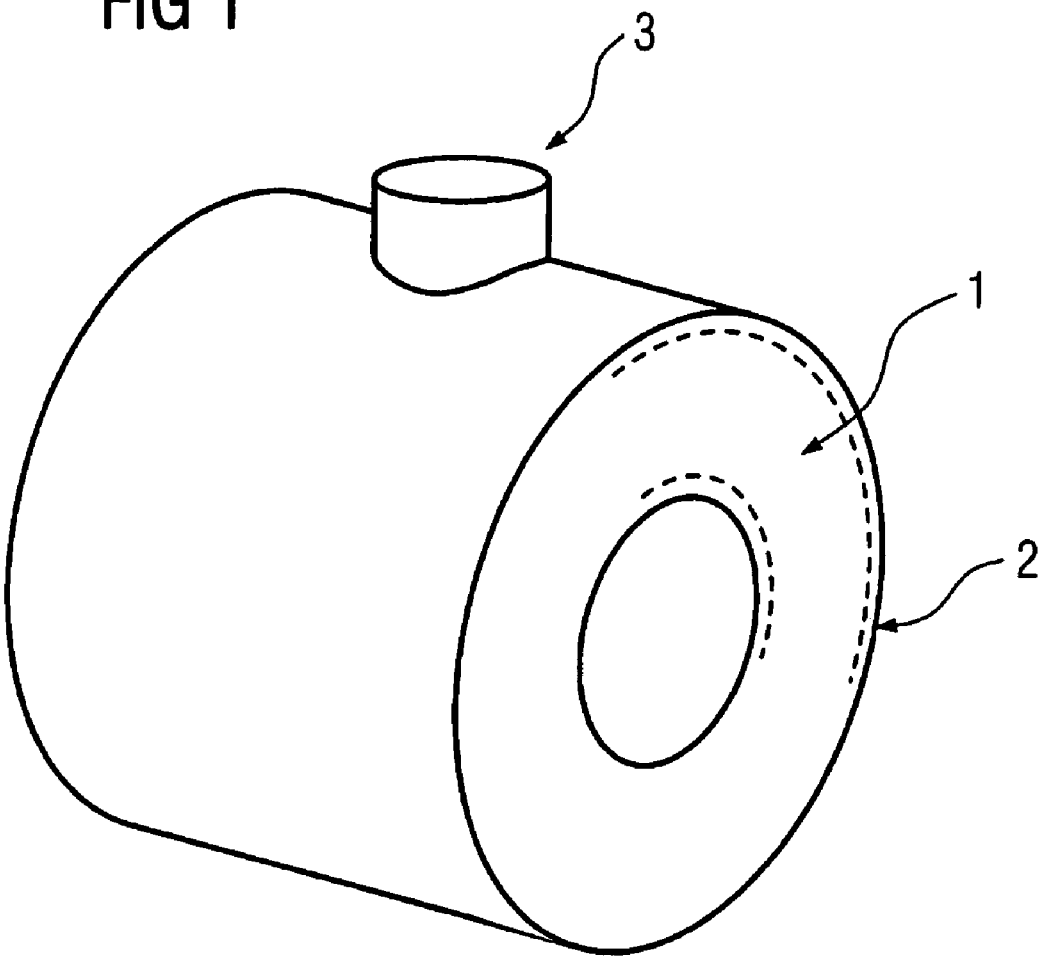
FIG. 1 shows a schematic diagram of a magnetic resonance device according to the invention without a housing and with the cryostat illustrated.

Reference will now be made in detail to the preferred embodiments of the present invention, examples of which are illustrated in the accompanying drawings, wherein like reference numerals refer to like elements throughout.

FIG. 1 shows a magnetic resonance device 1 according to the invention in which the housing is not illustrated for reasons of clarity. A cryostat 2, which is already arranged around the superconductive basic field magnet of the magnetic resonance device 1, is shown. As can be seen, the cryostat 2 completely surrounds the magnet and the other components, i.e. both on the wall surfaces and on the end sides. A tower 3 is provided in the upper region of the cryostat 2 and in it is situated a connecting branch which is described in greater detail below and is connected to a coolant chamber of the cryostat 2, in which chamber a coolant, for example liquid nitrogen or especially liquid helium, is situated during operation. The connecting branch can thus be used to introduce this coolant into the coolant chamber and to top it up as the need arises.

Figure 2:
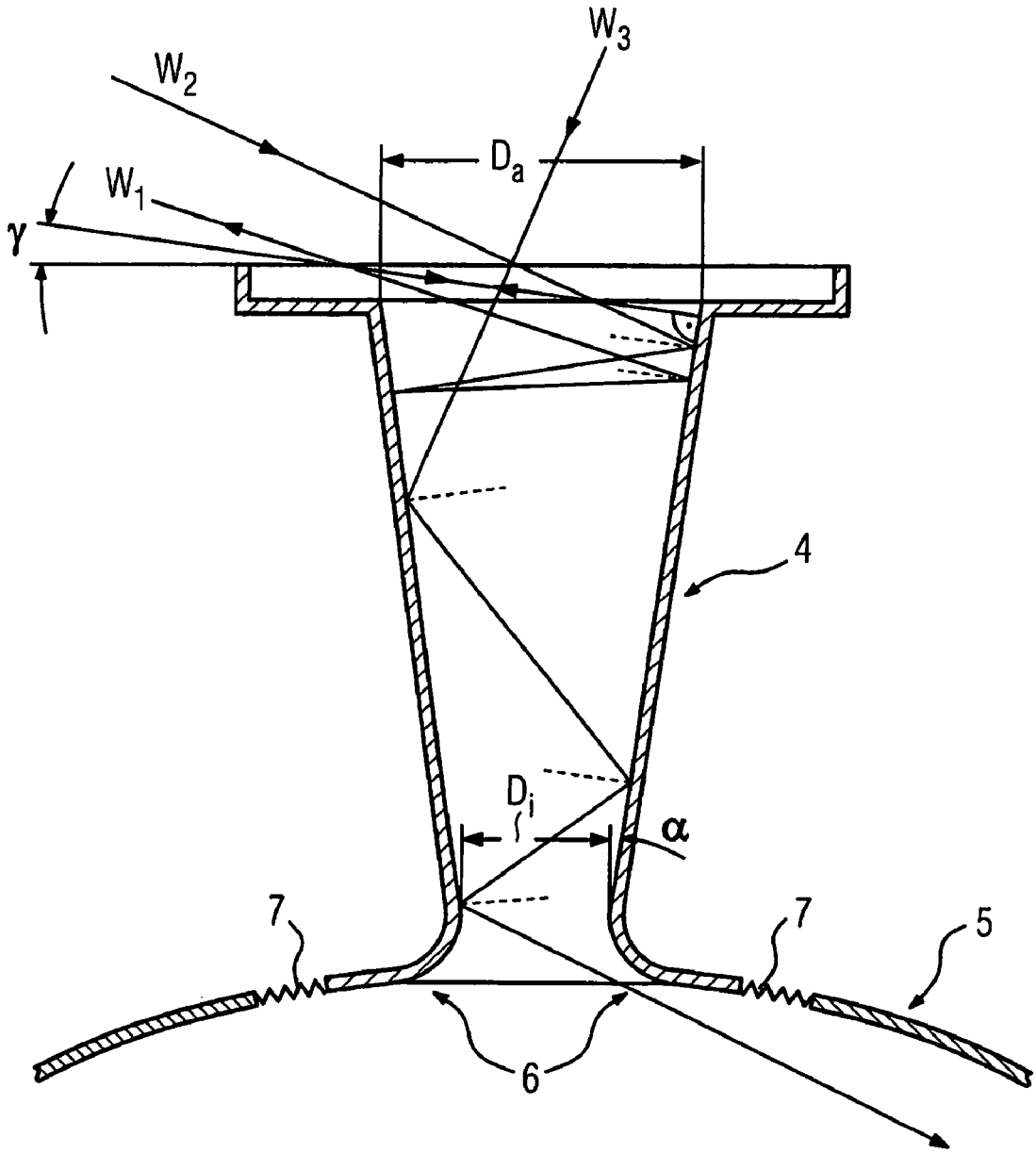
FIG. 2 shows a detailed view of a connecting branch according to the invention of a first embodiment in the form of a schematic diagram.

FIG. 2 shows a first embodiment of a connecting branch 4 according to the invention. The connecting branch is of essentially nozzle-shaped design. It increases its diameter from a narrow inside diameter $D_i$, in the region of the transition of the connecting branch 4 to the wall 5 of the cryostat, to an outside diameter $D_a$ at the open exit of the connecting branch 4. The diameter increases linearly, i.e. the connecting branch is of essentially frustoconical design. In its transition region to the wall 5 of the cryostat (the wall is only illustrated by way of example here and normally includes a plurality of wall sections including vacuum chambers and insulating shields and is used for insulating the adjoining coolant chamber in which there is, for example, liquid nitrogen (77 K) or liquid helium (4.3 K)), the connecting branch 4 is connected to the wall via a curved connecting section 6. All in all, the configuration of the connecting branch 4 and of its connecting region is similar to that of a Laval nozzle. In the example shown, the connecting section is adjoined by a bellows-like expansion section 7 which is used for absorbing any expansions in the material or fabric.

Owing to the conical nature of the connecting branch 4, the perpendicular of the wall surface is at an angle $\gamma$ with respect to the horizontal. The opening angle of the connecting branch is $\alpha$, $\alpha$ in this case being equal to $\gamma$.

If heat radiation is now incorporated into the connecting branch, then some of the heat radiation, which is incorporated at an angle of $\leqq\gamma$ with respect to the horizontal, is reflected by the obliquely set wall. FIG. 2 shows an idealized heat ray $W_2$ which impacts against the wall of the connecting branch 4 and is reflected along ray $W_1$, as is illustrated in FIG. 2. Heat radiation which enters at a smaller angle is likewise completely reflected to the outside, i.e. not into the connecting branch.

Only heat radiation which enters at a larger angle (like the heat ray $W_3$ in the example shown) is likewise reflected, but into the interior of the connecting branch 4. However, owing to the diverging form of the connecting branch 4, multiple reflection takes place in the connecting branch itself, as is shown in FIG. 2. The radiation path is thus significantly extended owing to the diverging form, so that owing to the transfer of energy to the wall of the connecting branch 4, which transfer takes place during each reflection process and is caused by the reflection, the quantity of energy or heat which actually arrives in the lower region of the connecting branch 4 is small. In the ideal case, the heat radiation peters out over the path of reflection.

The opening angle of the connecting branch 4 is not to be selected to be too large so as to prevent the flow from separating. However, at the same time it is to be sufficiently large in order to readily utilize the effect described. The larger the opening angle $\alpha$, the greater is the angle section within which heat radiation is reflected to the outside.

The inner wall of the connecting branch 4 can be covered by a coating or can be surface-treated. For example, it may be covered with an absorbent coating, especially in the upper entry region, with the result that heat radiation impacting there is absorbed to the greatest possible extent or completely. There is also the possibility of coloring the inner wall black by a surface treatment, which has a similar effect. A reflective surface can also be produced, for example by polishing. The particular coatings or surface treatment may be provided only in some sections and different combinations are also conceivable. This is to be optimized in accordance with the proposed problem in each case, i.e. whether the heat transport by heat radiation or by f heat conduction predominates.

Owing to this refinement according to the invention of the connecting branch, the use of any radiation screens can advantageously be omitted, since the quantity of heat actually input can also be significantly reduced without the use of these radiation shields. The direct heat radiation (directed, unreflected) is ultimately negligible. Diffuse heat radiation, both in the form of reflected and also re-emitted heat radiation, is, as described, significantly reduced owing to the measures according to the invention, which results, overall, in a small input of heat into the cryostat and a very small pressure loss in the event of a quench.

Figure 3:
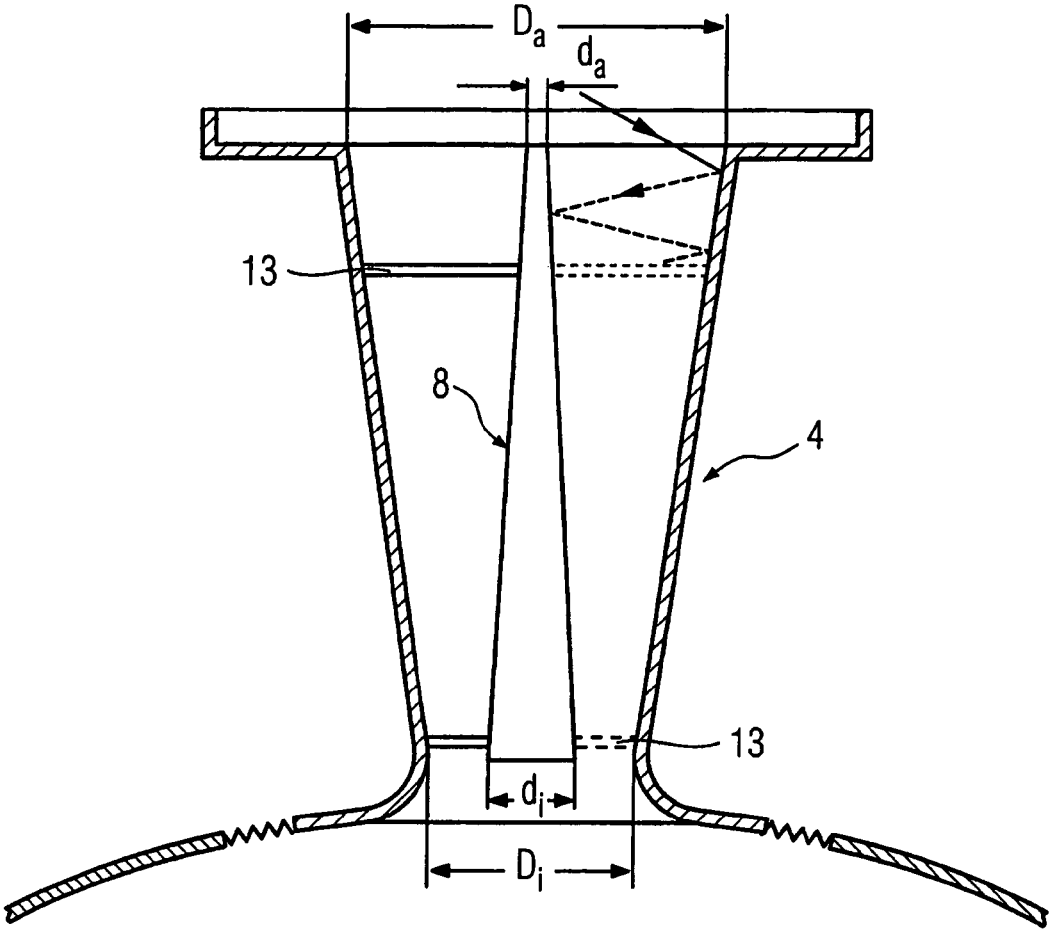
FIG. 3 shows an illustration of the connecting branch from FIG. 2 with an additional, central component arranged in it.

FIG. 3 shows the connecting branch 4 from FIG. 2. A component 8 is provided in the latter, essentially arranged concentrically and has supports 13, e.g., from the inner wall of connecting branch 4. This central component 8 is elongate and rod-shaped. It likewise has a conically tapering form, but the diameter tapers from a large inside diameter $d_i$ to a smaller outside diameter $d_a$. That is to say, the profile is diametrically opposed to that of the connecting branch. Since reflections may also occur on this component 8, as shown in FIG. 3, it is advantageous also to select here a corresponding, diverging form which results in an extension of the path of reflection. The narrowest part of the nozzle-like annular gap, which part is situated in the interior between the connecting branch 4 and the component 8, is to be matched to the free flow cross section which is required.

Whereas in the present document the situation regarding reflection has primarily been described, the same of course also applies with regard to the emission of heat radiation from the connecting-branch wall which may heat up locally. The directional dependence is also advantageously utilized here.

Like the wall of the connecting branch, the outer wall of the component 8 may also be correspondingly coated or surface-treated. The specific changing of thermal-optical surface properties is thus expediently used on all of the reflection or emission surfaces present within the connecting branch in order to reduce the radiation-induced transport of heat or heat input into the cryostat.

Figure 4:
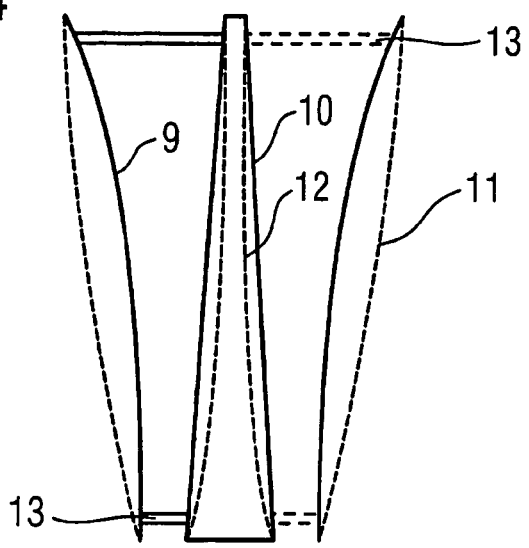
FIG. 4 shows a schematic diagram in order to illustrate other opening geometries of the connecting branch and of a central component arranged in it.

FIG. 4 finally shows two further possible connecting branch and component geometries which can likewise be used for obtaining the advantageous effect described. As the extracted illustration of the connecting branch 9 shows, it is possible for the connecting branch to be enlarged in its diameter from the inside to the outside and to have a concavely curved outer wall. The corresponding component 10 tapers in its diameter from the inside to the outside, but in this case has an outer wall which is convexly curved outward.

This configuration can also be turned around, thus, the connecting branch 11 exhibits a concavely outwardly curved form while the correspondingly shaped, diametrically opposed component 12 has a convexly inwardly curved outer wall.

The invention has been described in detail with particular reference to preferred embodiments thereof and examples, but it will be understood that variations and modifications can be effected within the spirit and scope of the invention.

What is claimed is:

1. A magnetic resonance device at least partially surrounded by an external environment, comprising:

a cryostat including a coolant chamber;

a superconducting magnet in said coolant chamber cooled by liquid helium; and a connecting branch, connecting the coolant chamber with the external environment at an open end and introducing the liquid helium into said coolant chamber, said connecting branch having a diameter expanding at an opening angle from an inside diameter at the coolant chamber to an outside diameter at the open end, the inside diameter being large enough to permit a free flow of evaporating helium in case of a quench of the superconducting magnet and small enough to suppress, in combination with the opening angle of said connecting branch and the outside diameter at the open end, incorporation of heat by radiation into said coolant chamber.

2. The magnetic resonance device as claimed in claim 1, wherein said connecting branch has an inner wall and includes an elongate component having an inner diameter tapering from an inside diameter to an outside diameter, and at least one support affixing the elongate component in said connecting branch without the elongate component touching said connecting branch.

3. The magnetic resonance device as claimed in claim 2, wherein the elongate component and the connecting branch are arranged concentrically.

4. The magnetic resonance device as claimed in claim 2, wherein the connecting branch has an inner wall and the elongate component has an outer wall, at least one of which is at least partially coated or surface-treated to influence at least one of absorption and emission behavior.

5. The magnetic resonance device as claimed in claim 4, wherein the at least one of the inner wall of the connecting branch and the outer wall of the elongate component is coated with a strongly absorbent coating.

6. The magnetic resonance device as claimed in claim 5, wherein the strongly absorbent coating is a non-metallic coating.

7. The magnetic resonance device as claimed in claim 4, wherein the at least one of the inner wall of the connecting branch and the outer wall of the elongate component is one of colored black and reflective by surface treatment.

8. The magnetic resonance device as claimed in claim 1, wherein the cryostat includes a housing and a wall section, and wherein the connecting branch is connected to one of the housing and the wall section of the cryostat via a curved connecting region.

9. The magnetic resonance device as claimed in claim 2, wherein the diameter of the elongate component tapers one of linearly, convexly and concavely.

10. The magnetic resonance device as claimed in claim 1, wherein the inner diameter of said connecting branch expands linearly.

11. The magnetic resonance device as claimed in claim 1, wherein said connecting branch expands one of convexly and concavely.

* * * * *